US005256240A

United States Patent [19]

Shortt

[11] Patent Number: 5,256,240

[45] Date of Patent: Oct. 26, 1993

[54] CORRUGATING MACHINE WITH A FLEXIBLE VESSEL PRESSURE APPLYING MEANS

[75] Inventor: Frederick Shortt, Emilia, Italy

[73] Assignee: Simon Container Machinery Limited, Stockport, England

[21] Appl. No.: 858,306

[22] Filed: Mar. 25, 1992

Related U.S. Application Data

[63] Continuation of Ser. No. 552,928, Jul. 13, 1990, abandoned.

[30] Foreign Application Priority Data

Jul. 18, 1989 [GB] United Kingdom ..... 8916373
Oct. 25, 1989 [GB] United Kingdom ..... 8924053

[51] Int. Cl.[5] ..... B31F 1/00

[52] U.S. Cl. ..... 156/470; 156/210; 156/580; 156/583.3; 100/211

[58] Field of Search ..... 156/210, 324, 443, 459, 156/462, 470, 543, 555, 580, 581, 583.3, 583.5; 100/211

[56] References Cited

U.S. PATENT DOCUMENTS 905,076 11/1908 Hinde ..... 100/211
3,434,901 3/1969 Griffiths et al. ..... 156/470 X
3,580,795 5/1971 Eichenlaub ..... 156/285 X

*Primary Examiner*—Jeff H. Aftergut
*Attorney, Agent, or Firm*—Nies, Kurz, Bergert & Tamburro

[57] ABSTRACT

A heat transfer system particularly though not exclusively for assisting the bonding of a continuous liner sheet to a single faced board in a corrugating machine where the single faced board (10), after gluing of the corrugated tips is brought together with the liner (12) and conveyed across a series of hot plates (15), the invention consisting of a series of vessels (20) containing a liquid or gas arranged above the conveyed board to press same uniformly in contact with the hot plate surface irrespective of distortion or undulation thereof thus to ensure adequate heat transfer and avoid damage to the board.

8 Claims, 2 Drawing Sheets

CORRUGATING MACHINE WITH A FLEXIBLE VESSEL PRESSURE APPLYING MEANS

This is a continuation of application Ser. No. 552,928 filed Jul. 13, 1990, now abandoned.

THIS INVENTION relates to heat transfer systems wherein a continuous web of material is to be transported across the surface of one or more hot plates whereby the web is subjected to an elevated temperature for a predetermined period.

Particularly, though not exclusively, the invention is concerned with corrugating machinery in which so-called single faced board with glue applied to the exposed tips of a corrugated sheet is brought together with a liner which is thus bonded to the glued tips to form a double faced board, and the composite board is carried beneath a conveying belt past a bank of heaters which assist in the bonding of the liner to the corrugated tips of the single faced board.

Conventionally, a system of this kind incorporates a series of weight rolls which bear on the conveying belt to maintain contact between the board and the hot plate surfaces of the heaters, in order to ensure adequate heat transfer.

This arrangement suffers from the disadvantage that the hot plate surfaces tend to become distorted, particularly when the belt is transported at high speeds, leading to uneven heat transfer and zones of excessive loading where the material may become crushed.

An object of the present invention is to provide a heat transfer system w herein the aforementioned disadvantage is at least substantially avoided.

According to the present invention there is provided a heat transfer system in which a continuous web of material is carried past a series of hot plates, there being means imposing a load on the face of the material remote from the hot plates to maintain contact between the material and the hot plates; characterised in that said load applying means includes at least one flexible vessel containing a fluid medium and adapted to press said material against the hot plates thereby to conform to the surface of the latter irrespective of any undulation thereof.

Embodiments of the invention, will now be described, with reference to the accompany schematic drawings, in which.

Figure 1:
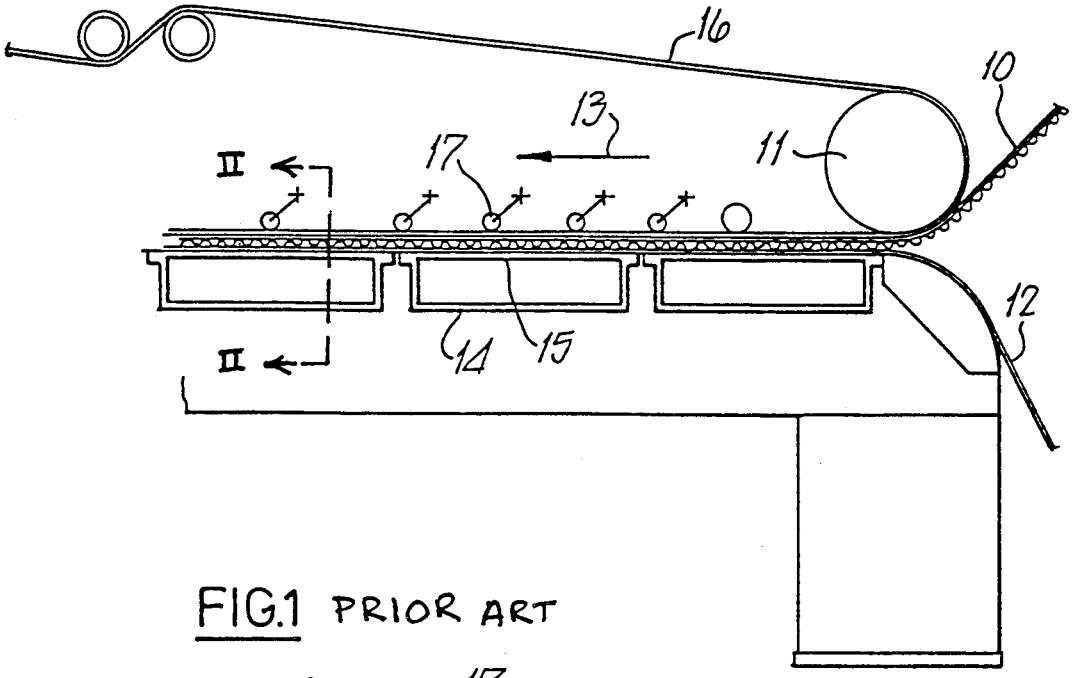
FIG.1 PRIOR ART
FIG. 1 is a side elevation of a conventional heat transfer machine for bonding a liner sheet to a single faced and glued corrugated board.

Referring now to FIG. 1, in a conventional system a single faced corrugated board 10 with glue applied to the tips of the corrugations is brought together, beneath a roller 11, with a continuous liner sheet 12. The double faced board so formed then travels in the direction of arrow 13 across a number of steam chests 14 providing a continuous upper hot plate surface 15.

Also passing around roller 11 and riding in superimposed relationship on the double faced board is a continuous conveying belt 16.

A series of weight rollers 17 bear against the upper surface of belt 16 as it passes over the hot plate surfaces 15 to maintain contact between the latter and the liner 12.

Figure 2:
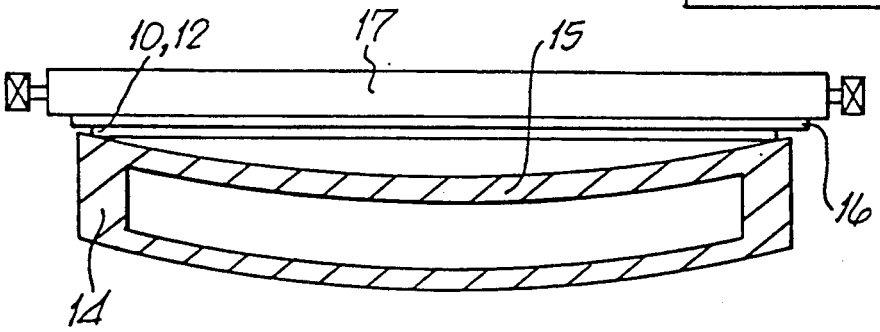
FIG.2 PRIOR ART
FIG. 2 is a vertical section taken along line II—II of FIG. 1.

It has been found, particularly when the double faced board is carried through the machine at high speeds, that the resultant difference in temperature between the top and bottom walls of each steam chest 14 causes deformation so that the hot plate surface 15 becomes concave about an axis along the centre of the machine as illustrated in exaggerated form in FIG. 2. Thus, only the side edge regions of the board 10, 12 are maintained in contact with the hot plate surface 15. This leads to inadequate heat transfer and mechanical damage to the sides of the finished board.

The present invention is based upon an appreciation of the need to permit the board to follow any distortion or undulation of the hot plate surface, thus ensuring uniform contact and heat transfer across the entire width of the board.

Figure 3:
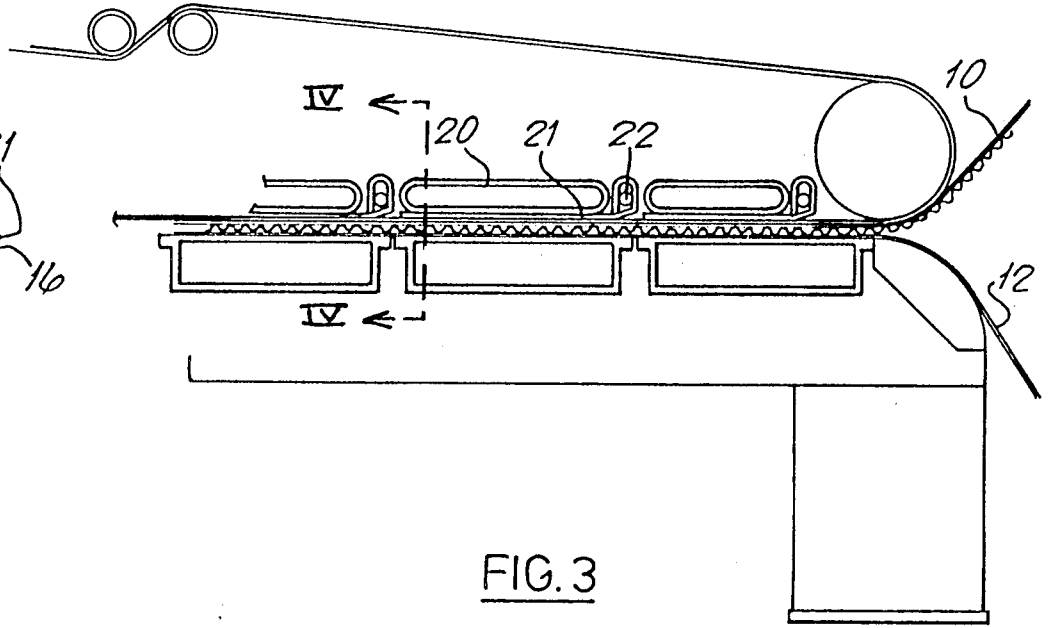
FIG. 3 is a view similar to FIG. 1 of a heat transfer machine made in accordance with a first embodiment of the invention.

Thus, in accordance with one embodiment of the invention and with reference to FIG. 3 it will be seen that the weight rollers 17 are replaced by a series of flexible vessels or bags 20 which are at least partially filled with water. Each vessel 20 bears upon a thin steel plate 21, of between 1.5 mm and 2 mm in thickness, which is loosely pivotable about a transverse rod 22 at its upstream end in relation to the direction of travel of the board. The vessels 20 may be made from natural or artificial rubber or a flexible plastics material, and each is preferably provided with filling and drainage means for topping up or for controlling the volume of water contained in them and thus the weight applied by them.

Figure 4:
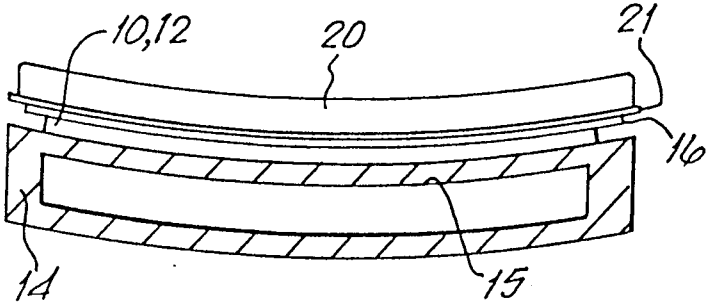
FIG. 4 is a view similar to FIG. 2, taken on line IV—IV of FIG. 3.

Accordingly, as illustrated in FIG. 4, due to the flexibility of the vessels 20 and the plates 21, the board 10,12 is maintained in contact with the hot plate surfaces 15 irrespective of any undulation or distortion thereof. Therefor, efficient heat transfer is ensured and there is substantially uniform pressure applied right across the board thus avoiding crushing of the side regions thereof. Other advantages include reduced maintenance, even pressure applied to the hot plates, and the achievement of higher machine speeds owing to the complete heat transfer afforded.

With appropriate filling and draining facilities the weight may be adjusted by an operator, according to the conditions prevailing.

The liquid contained within the vessels 20 may be other than water, and the attitude and arrangement of the various parts may be other than as a flat bed process as illustrated. Clearly if the board is to travel vertically instead of horizontally then some means will be required to apply a load to the back of the vessels 20 to urge them towards the belt 16.

If required, in certain applications, the conveying belt 16 may be omitted.

Figure 5:
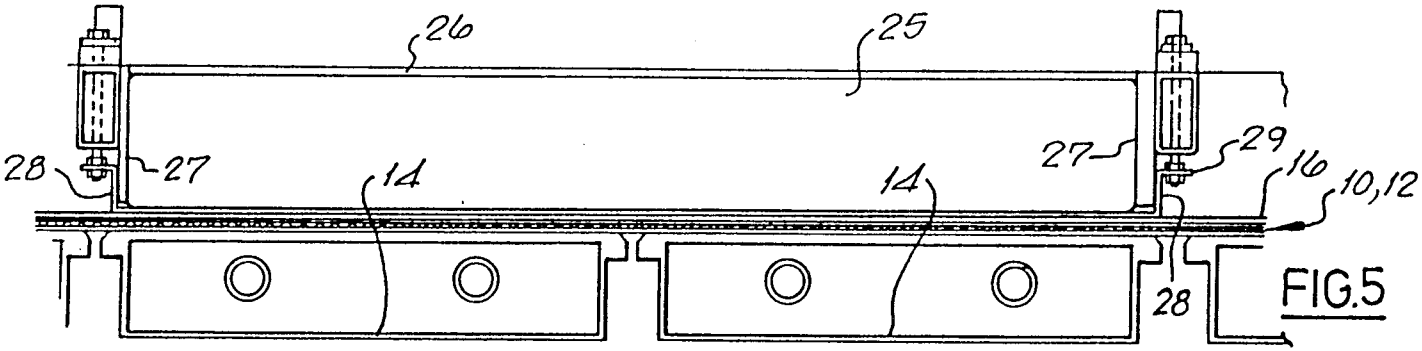
FIG. 5 is a view similar to FIG. 3, of a heat transfer machine but showing a second embodiment.

Referring now to FIG. 5, in place of the liquid-filled vessels 20, there is provided, as an alternative, a series of gas filled bags 25 above the belt 16. Each bag 25 is constrained by a fixed upper plate or grille 26 and side members 27. A flexible plate 28 is fixed at 29 to the machine framework and extends beneath the bag 25 above belt 16.

As illustrated, each bag 25 may span two steam chests 14.

Inflation of the bags 25 is adjustable to determine the load imposed on the belt, but as with the liquid-filled vessels, the bags will enable the plates 28 to follow any undulation in the belt 16 and board 10, 12 due to distortion of surfaces 15.

Above upper plate 28, and arranged side by side across the width of the belt 16, there may be several inflatable bags 25 so that, for example, when handling narrow board, only a central one of the available bags may be utilised. In this case, a separate inflation valve is required for each bag so that the operator may select the areas where overhead pressure is to be applied.

I claim:

1. A corrugating machine in which a continuous single-faced corrugated board consisting of a corrugated sheet glued on one face to a first flat sheet and with glue applied to the exposed tips on the opposite face of the corrugated board, is to be brought together while continuously advanced through the machine with a second flat sheet to be adhered to said exposed tips, the machine comprising a stationary and substantially rigid hot plate surface over which the second flat sheet with the single-faced board superimposed thereon, is conveyed to cure the glue and produce a double faced board, and means to apply a load on a face of the double faced board which is remote from the hot plate surface to maintain thermal contact between the conveyed double faced board and the stationary hot plate surface; characterized in that said hot plate surface comprises a series of individual hot plates aligned in a direction of travel of the double faced board, in that said load applying means includes a series of flexible vessels aligned in the direction of travel of the double faced board and each separately containing a fluid medium and adapted to maintain said double faced board pressed uniformly against the hot plate surface as the double faced board is advanced over the hot plates during conveyance through the machine, thereby to conform to said surface irrespective of any undulation thereof, and wherein the fluid containing vessels rest upon at least one flexible plate which is fixed at one end thereof relative to said fluid containing vessels and which may assume a curvature about an axis extending in the direction of travel of the double faced boards.

2. A corrugating machine according to claim 1, wherein each fluid containing vessel rests upon an individual flexible plate which in turn slidably rests upon a surface of the conveyed double faced board.

3. A corrugating machine according to claim 2, wherein said double faced board travels in one direction, and each flexible plate is loosely pivotable upon a member extending transversely across the plate at its upstream end thereof in relation to the direction of travel of the double faced board.

4. A corrugating machine according to claim 2, wherein the flexible plate is of steel and has a thickness of between 1.5 mm and 2 mm and having a width at least as great as the double faced board.

5. A corrugating machine according to claim 1, wherein each said flexible vessel is in a form of a bag containing a liquid with filling and draining means such that a quantity of liquid contained therein may be adjusted.

6. A corrugating machine according to claim 1, wherein each said flexible vessel is in a form of a bag containing a gas at superatmospheric pressure, with adjustable inflation means, and a rigid constraining member above the bag.

7. A corrugating machine according to claim 6, including several inflatable bags arranged side-by-side across the machine with separate inflation means to enable said side-by-side bags to be inflated selectively.

8. A corrugating machine according to claim 1, wherein said hot plate surface is arranged horizontally and is superimposed by a moving double faced board and then said load applying means above the moving double faced board.

* * * * *